United States Patent [19]

Lindley

[11] 4,268,080

[45] May 19, 1981

[54] MANUAL TOOL FOR FEEDING REFUSE TO A GARBAGE GRINDER DISPOSAL

[76] Inventor: William L. Lindley, P.O. Box 1292, Conroe, Tex. 77301

[21] Appl. No.: 113,583

[22] Filed: Jan. 21, 1980

[51] Int. Cl.[3] ..... A47F 13/08

[52] U.S. Cl. ..... 294/1 R; 294/15; 15/105

[58] Field of Search ..... 294/15, 25, 26, 26.5, 294/1 R; 15/105, 236, 245, 104.02, 104.03, 104.05, 211, 212, 213, 245; 4/290, DIG. 4; D2/361; D15/93; D3/DIG. 1

[56] References Cited

U.S. PATENT DOCUMENTS 3,427,636 2/1969 Seifert ..... 15/105

3,780,393 12/1973 Gaetke ..... 294/1 R

*Primary Examiner*—James B. Marbert

*Attorney, Agent, or Firm*—Jack W. Hayden

[57] ABSTRACT

A manual tool for feeding refuse to a garbage grinder disposal includes a unitary body with a head portion adjacent one end of the body. The head portion is provided with a plurality of spaced, longitudinally extending recess means to define longitudinally extending ribs between the recess means whereby the tool may be manually grasped. Shaft means extend longitudinally from the head portion and is of a size for inserting in the garbage grinder disposal, and surface means are provided on the end of the shaft means and project therefrom whereby refuse may be engaged by manual manipulation of the tool and stuffed into the garbage grinder. Surface means on the tool limit the extent the shaft means may be inserted in the garbage grinder disposal.

2 Claims, 3 Drawing Figures

MANUAL TOOL FOR FEEDING REFUSE TO A GARBAGE GRINDER DISPOSAL

SUMMARY OF THE INVENTION

Various means have been employed as feeder tools for garbage grinder disposals including fingers, spoons, knives, spatulas, and any other similar objects which function to try to push the refuse through the baffles of the garbage grinder disposal. In some instances, disasterous results have occurred from using various objects as feeder tools for garbage disposal. For example, the garbage grinder disposal will throw particles, including hard particles such as bone chips indiscriminately which causes them to find their way through the rubber baffles at the top of the garbage grinder disposal. The discharge of particles from the garbage disposal is dangerous, and in some instances people have had their eyes or other parts of the anatomy injured as a result of the discharge from a garbage grinder disposal.

In other instances, hands and fingers have been mutilated as a result of putting the hands or fingers into the garbage grinder disposal. Also egg shells and other sharp debris in the garbage grinder disposal either cut the hands or fingers or gets under the finger nails and in some instances promotes infection or illness.

The present invention provides an instrument or tool which is functionally designed to corral refuse and safely stuff it through the rubber baffles into the grinding chamber of a garbage grinder disposal such as found in the average kitchen.

An object of the present invention is to provide a relatively simple device which is safe in operation to corral or feed refuse through the rubber baffles and into the grinding chamber of a garbage grinder disposal, even while it is in operation, without any damage to the tool or to the manipulator thereof.

Other objects and advantages will become apparent from a consideration of the following drawing and description.

DESCRIPTION OF THE PREFERRED EMBODIMENT

Figure 2:
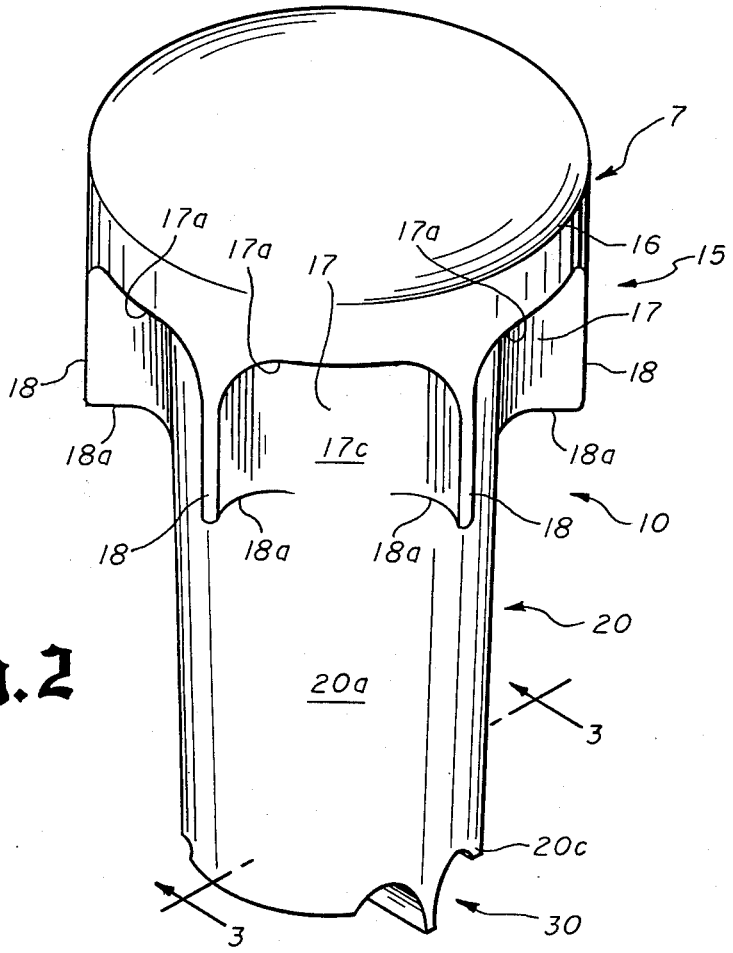
FIG. 2 is an enlarged perspective view of the preferred embodiment of the present invention.

Attention is first directed to FIG. 2 of the drawings wherein the tool of the present invention is referred to generally by the numeral 7. It will be noted that it comprises a unitary body referred to generally by the numeral 10 with the body including a head portion referred to generally by the numeral 15 and a shaft means referred to generally by the numeral 20 extending longitudinally from the head portion.

In the embodiment shown, the tool is shown as being circular in configuration; however, this is only exemplary and it can be appreciated that any suitable configuration of the present invention other than circular may be employed.

The head portion 15 is adjacent one end 16 of the body designated at 10. The head portion 15 is provided with a plurality of spaced, longitudinally extending recess means 17, with the space between adjacent recesses defining longitudinally extending ribs 18 as shown in the drawings. It will be further noted that the recess means 17 has one end **17*a* which is longitudinally spaced from the end 16 of the body 10 to thereby form an overhang 17*b* adjacent one end of the recess means 15**.

The bottom surface **17*b* of the recess means, in the form of the invention illustrated in the drawings, is generally in the same plane as the surface 20*a* on the shaft means 20**.

It will be further noted that the shaft means 20 is tapered as represented by the numeral **20*b* towards the end thereof on which surface means 30** are formed.

In the form of the invention illustrated, the head portion 15 of the tool 10 is larger than the shaft means 20, so that the rib means 18 projects outwardly of the surface **20*a* of the shaft means 20 as shown in the drawings. This enables the end surface 18*a* of the rib means 18 to function as a safety stop to limit penetration of the shaft means 20** into the grinding chamber C of the grinder G to a safe depth, even while the grinder G is in operation without engaging the grinder mechanism.

Figure 3:
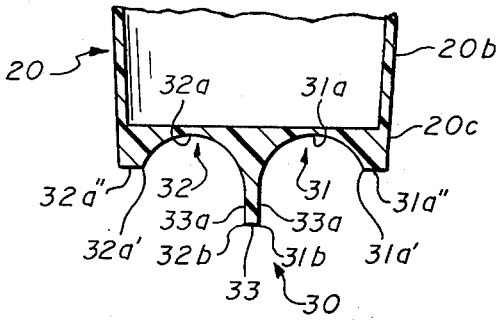
FIG. 3 is a partial sectional view of one end of the tool of the present invention illustrating in greater detail a surface means for corraling and feeding refuse into a garbage grinder disposal.

Surface means 30 projects from the other end **16*a* of the body means 11 and more particularly projects from the end 20*c* of the shaft means 20 and serves to enable refuse to be corraled and stuffed through the elastomer baffles R and into the grinding chamber C of the garbage grinder disposal G. The surface means 30 is formed as better shown in FIG. 3 of the drawings wherein it can be seen that the surface means 30 is formed by a pair of arcuate grooves 31 and 32. Each groove 31, 32 is formed generally by the arcuate surfaces 31*a* and 32*a* respectively extending across the end 20*c* of the shaft means 20 as shown in the drawings. The end 31*a*′ of the arcuate surface 31*a* and the end 32*a*′ of the arcuate surface 32*a* terminates adjacent, but spaced from the surface 20*a* of the shaft means 20 to form the laterally extending surface 31*a*″ and 32*a*″ as shown more clearly in FIG. 3**.

The other ends of each arcuate groove 31 and 32 terminate in spaced relation to each other as shown at **31*b* and 32*b* respectively. Also, it is to be noted that the ends 31*b* and 32*b* terminate not only in spaced relation to each other, but also terminate in the same plane as the longitudinal axis of the shaft means 20 to form a projecting surface or rib 33 which extends laterally across the end 20*c* of the shaft means 20. It is to also be noted that the end of the rib 33 projects beyond the end of the surfaces 31*a*″ and 32*a*″ whereby the depending rib 33 along with the concave and arcuate surfaces 31*a* and 32*a* of the grooves 31 and 32 assist in corraling and moving refuse along a surface by manual manipulation of the tool 10 and then stuffed through the rubber baffles R of the garbage grinder G as illustrated in FIG. 1** of the drawings.

Figure 1:
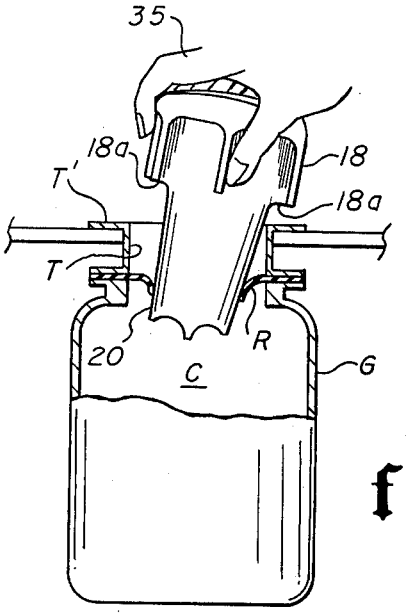
FIG. 1 is a view illustrating the present invention being inserted through the rubber baffles at the top of a garbage grinder disposal.

It can be appreciated that as illustrated at 35 in FIG. 1 of the drawings, the tool 10 of the present invention may be manually grasped, and the recess means 17 along with the ribs 18 accommodate manual grasping of the tool 10 for manipulation thereof to propel or move refuse and the like along a surface and through the throat T, the rubber baffles R, and into the grinding chamber C of the grinder G.

The lower ends 18*a* of the ribs 18 serve as a stop means for engaging the top T′ of the grinder G surrounding the throat T of the grinder G to prevent the shaft means 20 from interfering with operation of the grinder, or becoming engaged with the elements thereof, even during operation of the grinder.

As previously mentioned, the configuration of the tool 10 of the present invention is shown as being circular in the drawings wherein the head portion 15 is of an annular configuration with the ribs 18 formed between the recesses 17 projecting radially from the shaft means 20. However, the present invention could be constructed wherein the recesses are formed in the upper end of a shaft means with the ribs therebetween to provided a means for manual grasping of the tool 10. In such arrangement the ribs could project radially beyond the surface 20*b* of the shaft in which the recess means 17 are formed to provide a stop means and a means for manually grasping the tool.

Also, the shaft means 20 is shown as having an annular surface 20*a*, and it likewise could be formed in other configurations so as to provide an arrangement for accomplishing the benefits of the present invention.

In use of the present invention it would be manually grasped as represented by 35 in FIG. 1 of the drawings. Refuse on a counter, sink or the like is moved by engaging it with one of the sides 33*a* of the rib 33 and moving the refuse, garbage and the like towards the throat T of the garbage grinder G. Thereafter, the tool 10 and the refuse may be stuffed through the elastomer baffles R at the top of the grinder G so that the refuse is forced into the grinding chamber C of the grinder G. It can be appreciated that this operation can be carried out while the grinder is in operation since the ribs 18 function as a stop to prevent penetration of the shaft means 20 into the grinding chamber C to an extent that would interfere with operation of the grinder.

The tool may also be described as comprising shaft means 20, with surface means 15 forming an arrangement to enable the shaft means 20 to be manually grasped and manipulated.

Also, the shaft means 20 may be further described as including stop means in the form of any suitable projection means such as by way of example the rib means 18 to limit penetration of the shaft means 20 into the grinder so that the shaft means may safely be inserted in the grinder even when in operation without engaging or being damaged by the grinder mechanism.

The surface means 30 on the shaft means 20 is configured in any suitable manner, preferably as shown, to assist in corraling, guiding and feeding refuse through the elastomer baffles.

The foregoing disclosure and description of the invention are illustrative and explanatory thereof, and various changes in the size, shape, and materials as well as in the details of the illustrated construction may be made without departing from the spirit of the invention.

What is claimed is:

1. A manual tool for feeding refuse to a garbage grinder disposal comprising:

a. a unitary body;

b. said body including:

(1) a head portion adjacent one end of said body;

(2) said head portion having a plurality of spaced, longitudinally extending recess means therein to define longitudinally extending ribs between said recess means;

(3) shaft means extending longitudinally from said head portion and of a size for inserting in the grinder; and (4) surface means projecting from the end of said shaft portion whereby refuse may be engaged by manual manipulation of the tool and stuffed into the garbage grinder.

2. The tool of claim 1 wherein:

a. said recess means are longitudinally spaced from said end of said body to thereby form an overhang adjacent one end of said recess means;

b. the bottom surface of said recess means is generally in the same plane as the surface on said shaft;

c. said shaft is tapered towards the end thereof on which said projecting surface means is provided; and d. said surface means which projects from the end of said shaft being formed by a pair of arcuate grooves which extend across the end of said shaft with one end of each arcuate groove terminating adjacent the surface of said shaft, and the other ends of the arcuate grooves terminating in spaced relation to each other adjacent the longitudinal axis of said shaft means to form said projecting surface means which extends beyond said one end of each of said arcuate grooves.

* * * * *